US005453313A

United States Patent [19]

Kiser

[11] Patent Number: 5,453,313

[45] Date of Patent: Sep. 26, 1995

[54] ELASTOMERIC POLYSULFIDE COMPOSITES AND METHOD

[75] Inventor: Weldon C. Kiser, Abilene, Tex.

[73] Assignee: Environmental, L.L.C., Abilene, Tex.

[21] Appl. No.: 187,082

[22] Filed: Jan. 26, 1994

[51] Int. Cl.[6] ..... B32B 5/16

[52] U.S. Cl. ..... 428/143; 52/315; 52/408; 52/411; 52/DIG. 7; 52/DIG. 9; 428/147; 428/327

[58] Field of Search ..... 428/141, 143, 428/147, 323, 327; 52/408, 411, 309.1, 311.1, DIG. 7, DIG. 9, 554, 555, 315, 747, 746

[56] References Cited

U.S. PATENT DOCUMENTS

| | | | |
|---|---|---|---|
| 3,547,674 | 12/1970 | Draper et al. | 428/284 |
| 3,844,668 | 10/1974 | Winters et al. | 404/72 |
| 3,919,148 | 11/1975 | Winters et al. | 524/62 |
| 4,032,491 | 6/1977 | Schoenke | 524/68 |
| 4,196,115 | 4/1980 | Bresson | 524/68 |
| 4,640,730 | 2/1987 | Streets et al. | 156/334 |
| 4,897,137 | 1/1990 | Miller et al. | 156/157 |
| 4,897,443 | 1/1990 | Robinson et al. | 524/609 |

*Primary Examiner*—D. S. Nakarani
*Assistant Examiner*—H. Thi Lê
*Attorney, Agent, or Firm*—John L. Sigalos

[57] ABSTRACT

An elastomeric polysulfide composite in which rubber particles, particularly crumb rubber, are distributed substantially uniformly through an elastomeric polysulfide layer, roofing made from such composites, and the method of forming roofing in which the composite is associated with a rubber particle mat.

4 Claims, 1 Drawing Sheet

ELASTOMERIC POLYSULFIDE COMPOSITES AND METHOD

BACKGROUND OF THE INVENTION

The present invention relates to elastomeric polysulfide composites and the use of the same to form roofing such as tiles, shingles, built-up roofing and the like to form long-lasting, impact resistant roofing and to the method of forming such roofing.

At the present time there are a large number of materials used for roofing such as asbestos, wood or asphalt shingles, roofing tiles made of cement or clay, slate, coatings of tar, plastic or asphalt including asphalts modified with some synthetic resins, and roofing felt or some other roofing membrane which such asphalt, tar or a synthetic resin is placed.

However, all uniformly suffer from the problems of being insufficiently resilient so as to avoid damage when struck as by sleet or hail and not being sufficiently resistant to cracking when exposed to the usual yearly cycle of high summer temperatures and low winter temperatures. These problems are particularly exacerbated in the case of shed or flat roofs.

Liquid polysufide sheeting has been suggested as a method overcoming this problem and such is discussed in U.S. Pat. No. 4,897,443. However, such sheeting does not have sufficient structural strength to make a satisfactory roofing structure, particularly one that is exposed to hail which can extensively damage such sheeting.

SUMMARY OF THE INVENTION

The present invention overcomes the problems of the prior art and provides durable elastomeric polysulfide composites and roofing.

Briefly, the present invention comprises an elastomeric polysulfide composite comprising an elastomeric polysulfide having rubber particles distributed substantially uniformly therethrough. The invention also relates to roofing comprising a rubber particle mat having at least one layer of such elastomeric composite on at least one surface thereof. The invention further relates to the method of forming a roofing comprising applying a rubber mat to a roof and applying thereover a coating of a curable elastomeric polysulfide composite.

It is preferred to use an elastomeric polysulfide composite which contains a large percentage by volume of rubber particles.

DETAILED DESCRIPTION

Figure 1:
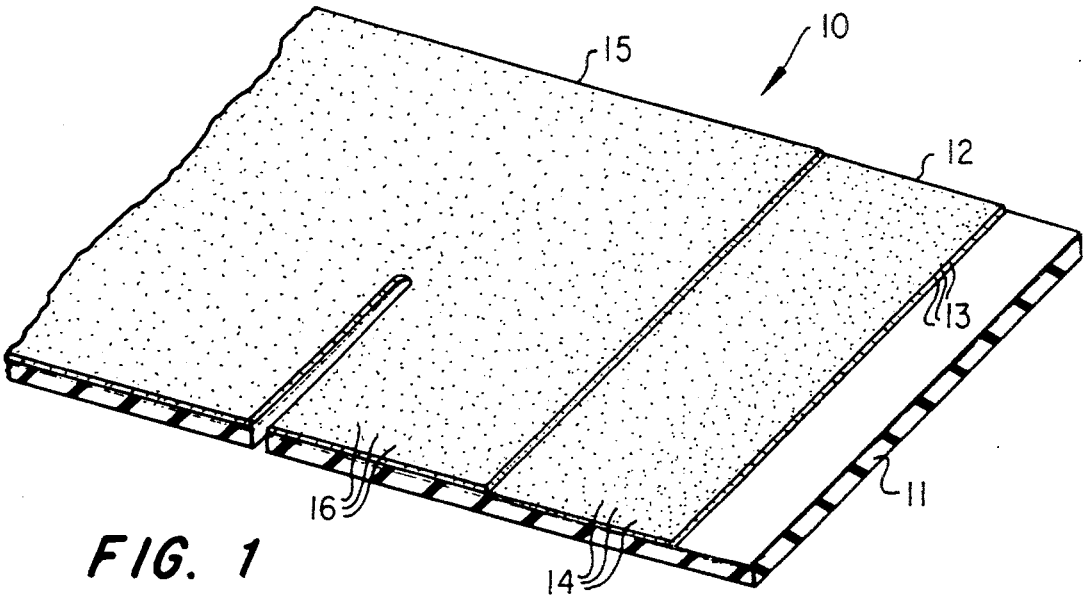
FIG. 1 is a perspective view, partially broken away, showing an elastomeric polysulfide roofing of the present invention in the form of a shingle.

The two essential elements of the composite of the present invention are rubber particles, preferably crumb rubber particles, and an elastomeric polysulfide. For roofing it is preferred to use a rubber mat therewith.

The rubber particles are conventional and are usually made of particles from scrap rubber materials such as old tires, and the like. They can be made from other materials such as styrene-butadiene rubber (SBR) crumbs which are of various mesh sizes and which can be tinted for aesthetic purposes and can have fire retardants added. Rubber mats or sheets are formed therefrom by adhering rubber particles together to form a unitary sheet or mat. It is preferred to use a polysulfide as a binder to form the mat. This enhances the bonding of the elastomeric polysulfide composite to the mat. Such crumb rubber mats are available in various grades as well as various widths and thicknesses and available usually in rolls and can be cut to the dimensions desired. If, in fact, a roofing shingle is to be formed, a continuous roll of the crumb rubber of the desired thickness is coated with the elastomeric polysulfide, as hereinafter discussed, and the resultant composite cut to the particular shingle shape desired. It will be evident that more than one layer of elastomeric polysulfide can be applied. It will also be evident that the type and thickness of the crumb rubber mat and elastomeric polysulfide coating used can be varied widely depending primarily upon the structural strength and resilience desired in the roofing structure. This is particularly true with respect to flat roofs in which there may be high foot traffic, or the setting of various hi-vac units or mechanical equipment. Thickness of the crumb rubber mat for such usage should be, therefore, much greater than for other surfaces nor subject to the above-noted stresses. Thickness of the mat and elastomeric polysulfide coating are also dependent upon the environment of the particular geographical location; i.e., severity of temperature change, wind velocity, and rainfall amounts.

With respect to the elastomeric polysulfide utilized, it can be any conventional curable liquid polysulfide rubber. As is known, liquid polysulfide materials are elastomeric and can contain a curing agent in addition to the liquid polysulfide rubber. The liquid polysulfide rubber can thus be epoxy cured, a water emulsion, or a combination of both. Such curing agents are well known and do not form a part of the instant invention and are used in amounts conventional for ambient curing. Ordinarily the chemical reaction is such that liquid polysulfide rubber will cure within twenty-four hours at normal ambient conditions, namely over about 40° F. It is not recommended that the liquid elastomeric polysulfide be applied at a temperature lower than 40° F.

It is preferred that the liquid elastomeric polysulfide rubber also contain a large percentage of rubber particles, such as crumb rubber particles, preferably a composition which contains 50% by volume of the liquid elastomeric polysulfide, be it a water emulsion or epoxy cured, and 50% by volume of the crumb rubber particles; i.e. particles made from scrap rubber or SBR as discussed above, and the like or mixtures thereof. This mixture not only make the outer liquid elastomeric polysulfide more resilient when cured, but also acts to limit the degree of penetration of the liquid elastomeric polysulfide into the crumb rubber mat to ensure that there will be a layer of the required thickness of the cured elastomeric polysulfide on the crumb rubber mat. Penetration of the liquid elastomeric polysulfide into the mat is desired since it acts to bond the two together and eliminate any separation over time. The polysulfide rubber being elastomeric, in combination with the crumb rubber mat, forms a roofing structure resistant to damage by hail, sleet and other objects that may come in contact therewith.

While not necessary, it is desirable to include as part of the liquid elastomeric polysulfide composition and in the crumb rubber mat, conventional materials added to roofing to provide fire resistance and self-extinguishing properties. It is also preferred to add to the liquid elastomeric polysulfide any material conventionally used to prevent or minimize ultraviolet degradation. These materials are added in their conventional amounts and for their usual effect.

The elastomeric polysulfide composites of the instant invention are formed by simply admixing the desired volume of rubber particles with the liquid polysulfide and permitting it to cure. These composites can be used as the top surfaces of sports tracks or playing fields, as sound dampening surfaces, or as roofing. They will be for that described in connection with roofing. As used herein, the term "roofing" means the barrier formed to protect the substrate against the elements.

The roofing of the instant invention is largely evident from the foregoing discussion, but reference to the drawings further illustrates the same. Thus, while shakes, tiles, panels, and other overlapping unit types can be formed and used only as shingle (individual overlapping unit) is illustrated. Also, the method of roofing is illustrated for new construction and for existing built-up-roofing. Lastly, while it is preferred to use rubber mats in conjunction with the elastomeric polysulfide composites, the composite alone can be used in some circumstances.

First, FIG. 1 shows shingle 10 comprising a crumb rubber mat base 11 with initial coating 12 of a liquid elastomeric polysulfide containing crumb rubber particles 13. A sprinkling of crumb rubber particles 14 is placed over the polysulfide coating and an additional layer 15 of elastomeric polysulfide applied and crumb rubber particles 16 sprinkled thereover. If desired, and in order to give shingles any particular colored appearance, a water-based latex additive or other tinting agent can also be included as part of the liquid elastomeric polysulfide and crumb rubber. It is possible to utilize a single layer of the liquid polysulfide rubber with only the final layer containing the latex in order to give the decorative color or appearance desired or equally, more than two layers thereof can be used. Also, the sprinkling of crumb rubber particles can be omitted and the conventional aggregate or SBR granules tinted to the desired color can be used on the top coat.

Figure 2:
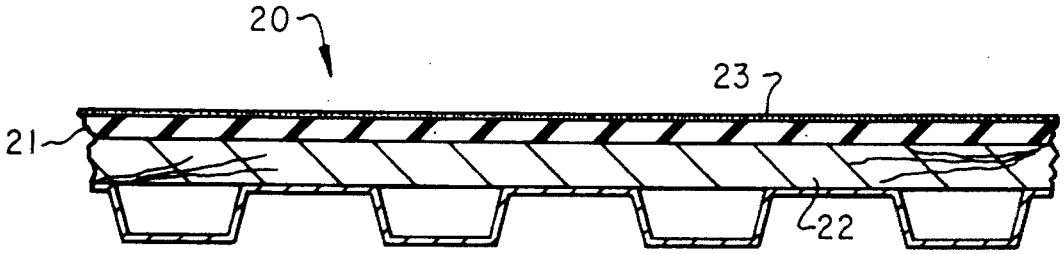
FIG. 2 is a partial sectional view of a new roofing structure in accord with the present invention.

Reference to FIG. 2 again shows a roofing structure 20 in accord with the present invention and suitable for use on a flat or shed roof in which mat 21 is applied over conventional roof decking 22. While a single mat roll is shown it is possible to use individual pieces of mat that are placed against each other. The edges of the butted-together mats are sealed using conventional self-adhesive or fabric tapes using the elastomeric polysulfide layer 23 applied as the adhesive. This forms a waterproof seam and also provides an expansion-type joint. Again, more than one layer of elastomeric polysulfide can be used and also crumb rubber particles may also be sprinkled thereover.

Figure 3:
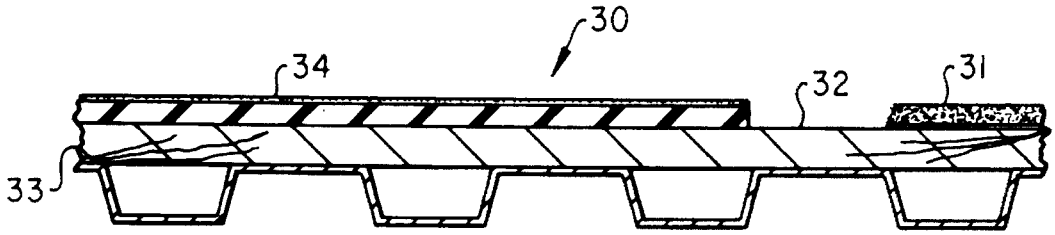
FIG. 3 is a partial sectional view of the present invention applied to a fully spudded existing roof.

FIG. 3 illustrates the utilization of the present invention on an existing built-up roof 30. The existing gravel and asphalt 31 are removed by the conventional spud process to expose the decking 32. There is then applied thereover crumb rubber mat 33, which is adhered to the decking with a quick set adhesive or the like, the elastomeric coating 34 as described in connection with FIG. 2. Again more than one layer of elastomeric polysulfide can be used.

Figure 4:
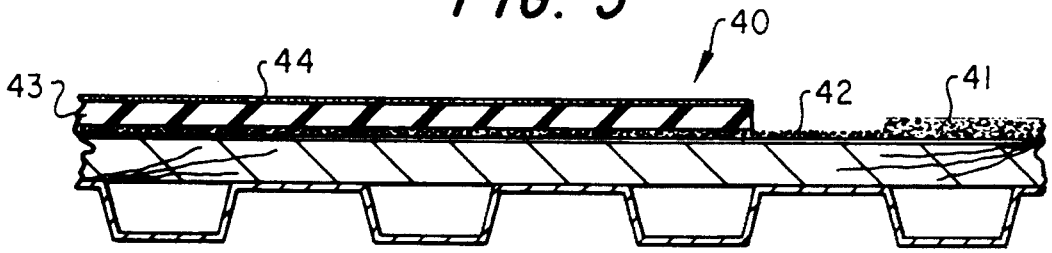
FIG. 4 is a partial sectional view of the present invention applied to a partially spudded existing roof.

FIG. 4 illustrates a modification of the invention in which a partial spud is used. Roof 40 is spudded to a depth to remove only gravel 41 thus exposing asphalt flood coat 42. Crumb rubber mat 43 and elastomeric polysulfide coating 44 are then applied as discussed above with the fully spudded roof.

As is known, the liquid elastomeric polysulfide can be applied by spraying, roller coating, troweling, or by squeegee. It is conventional to regulate the viscosity of the liquid polysulfide rubber in order to obtain the viscosity most suitable for each of such application procedures. Such viscosity adjustment is conventionally made with a typical solvent for the liquid polysulfide rubber, with the amount of solvent used being that necessary to obtain the desired viscosity. This can be readily determined by routine experimentation. Xylene is a suitable solvent, although acetone, isopropyl alcohol and other known solvents can be used.

The liquid elastomeric polysulfide utilized herein are conventional and, particularly, those sold under the trademark THIOKOL. These are of the general formula HS-$(RS_x)$n-RSH wherein x is 1 to 3, n can vary widely and R is an alkyl, alkylether or alkylthioester group wherein the alkyl group may have up to six carbon atoms. The particularly desired liquid polysulfide polymers are Thiokol LP3, LP33, LP977, P980, LP2 and LP32. They are two component 100% solid compositions which cure by the chemical reaction of the two components. It is preferred to use a version of the THIOKOL RLP composition liquid polysulfide elastomeric containing flame-extinguishing chemicals. Obviously, for roofing this is a desired feature.

The invention will be further described in connection with the following examples which are set forth for purposes of illustration only and in which proportions by weight stated to the contrary.

EXAMPLES 1 to 11

Eleven samples, 12 inch by 12 inch in size, and in accord with the present invention, were prepared as discussed below and tested for impact resistance, resistance to degradation by elements, and resistance to degradation by continual immersion in water. Commercially available shingles were tested as to impact resistance.

The test results are set forth in Table II below.

The samples of the present invention were made as follows:

(i) crumb rubber mats of various thickness and porosity (density) were coated with an elastomeric polysulfide composite of various thickness and with an elastomeric polysulfide rubber alone;

(ii) the elastomeric polysulfide composites consisted of a liquid polysulfide rubber and crumb rubber particles of various mesh sizes in various percentages by volume;

(iii) with some samples, crumb rubber particles of various sizes were sprinkled onto and pressed into the elastomeric polysulfide composite layer;

(iv) the composite was allowed to cure at ambient temperature and the shingles then tested.

The particulars of each shingle of the present invention are set forth in Table I below.

TABLE I

| | MAT | | POLYSULFIDE COMPOSITE | | | |
|---|---|---|---|---|---|---|
| | | | | | Crumb Rubber & Particle Size | |
| Example No. | Porosity (mesh size) | Thickness (inches) | Polysulfide Type | % by vol. | (mesh size) | % by vol. |
| 1. | Buffings/40–80 | 1/8" to 1/4" | A | 50% | 20 to 60 | 50% |
| 2. | Buffings/40–80 | ⅛" to ¼" | A & B | 50% | 20 to 60 | 50% |
| 3. | Buffings/40–80 | ⅛" to ¼" | A & B | 50% | 20 to 60 | 50% |
| 4. | Buffings/40–80 | ⅛" to ¼" | A | 50% | 20 to 60 | 50% |
| 5. | Buffings/40–80 | ⅛" to ¼" | A & B | 50% | 20 to 60 | 50% |
| 6. | Buffings/80 | ⅛" to ¼" | A & B | 50% | 20 to 60 | 50% |
| 7. | Buffings/80 | ⅛" to ¼" | A | 50% | 20 to 60 | 50% |
| 8. | 10–40 | ⅛" to ⅜" | A & B | 50% | 40 to 80 | 50% |
| 9. | 10–40 | ⅛" to ⅜" | A | 50% | 40 to 80 | 50% |
| 10. | Buffings/40 | ⅛" to ½" | A & B | 50% | 40 to 80 | 50% |
| 11. | Buffings/40 40 | ⅛" to ½" | A | 50% | 40 to 80 | 50% |

*The polysulfide per se was THIOKOL RLP Grade Elastomeric
A - Two-part epoxy cured polysulfide
B - Water emulsion polysulfide latex The porosity was calculated on the basis of the mesh size of the rubber particles.

The commercial shingles tested are also identified in Table II.

TABLE II

| Example No. | Impact Resistance ½" to 2" Ice Stones | Exposure to Environment | Water Immersion Deionized & Brine Water |
|---|---|---|---|
| 1 | No Effect Observed | No Effect Observed | No Effect Observed |
| 2 | " | " | |
| 3 | " | " | |
| 4 | " | " | |
| 5 | " | " | |
| 6 | " | " | |
| 7 | " | " | |
| 8 | " | " | |
| 9 | " | " | |
| 10 | " | " | |
| 11 | " | " | |

| Commercial Shingles | |
|---|---|
| 1. ELCOR | |
| 2. GAF | All showed exposed surface |
| 3. Owens-Corning | damage with 1 inch ice stones. |
| 4. American Cemwood-Cement/Wood Fiber | All showed thru penetration |
| 5. IKO Manufacturing | with 1 ¼ inch ice stones. |
| 6. TAMKO Asphalt Products | |

Impact resistance was measured by projecting ice stones at a velocity of 50 to 106 m.p.h. against the specimens and commercial shingles. The stones were formed with the following diameters (in inches), 0.5, .75, 1, 1.25, 1.5, 1.75, and 2 and projected from the smallest size to the next size until all sizes were projected or there was penetration.

Exposure to environment was measured after one-year exposure to the elements and after immersion was calculated by using 1 to 3 inch squares of each of the elastomeric polysulfide composite used to prepare each of the samples and flat roof samples, then immersing them in deionized water and brine for at least one year, and observing the specimens for blistering, separation, and softening.

From the test results it will be seen that the roofing of the present invention are virtually resistance to hail, and have excellent weathering and water-resistance properties.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A polysulfide roofing product comprising a rubber particle mat base having at least one layer of an elastomeric polysulfide having rubber particles distributed substantially uniformly therethrough on at least one surface thereof.

2. The roofing of claims 1 wherein said elastomeric polysulfide layer contains up to about 50% by volume of rubber particles.

3. The roofing of claim 1 wherein said product is in the shape of a roofing shingle.

4. The roofing of claim 1 wherein said one layer includes crumb rubber particles formed from scrap rubber, styrene-butadiene rubber, or mixtures thereof.

* * * * *